US005529294A

United States Patent [19]

Nordman et al.

[11] Patent Number: 5,529,294

[45] Date of Patent: Jun. 25, 1996

[54] LIGHTED STAND-UP TARGET

[75] Inventors: Dennis P. Nordman, Des Plaines; Armando X. Zuniga, Chicago; Steven J. Vornsand, Lake In The Hills, all of Ill.

[73] Assignee: Williams Electronics Games, Inc., Chicago, Ill.

[21] Appl. No.: 374,921

[22] Filed: Jan. 18, 1995

[51] Int. Cl.[6] ..... A63F 7/30

[52] U.S. Cl. ..... 273/118 R; 273/118 A; 273/121 A; 273/127 R; 273/127 D

[58] Field of Search ..... 273/118–121, 127 R, 273/127 B

[56] References Cited

U.S. PATENT DOCUMENTS 4,804,186 2/1989 Moravec ..... 273/127 R 4,934,699 6/1990 Kaminkow et al. ..... 273/121 A 5,158,290 10/1992 Norris et al. ..... 273/127 R X 5,158,291 10/1992 Biagi et al. ..... 273/127 R X

*Primary Examiner*—Raleigh W. Chiu

*Attorney, Agent, or Firm*—Rockey, Rifkin and Ryther

[57] ABSTRACT

The lighted stand-up target of the invention comprises a housing attached to the playfield and a target switch pivotably mounted to the housing. An array of light emitting diodes (LEDs) are positioned on a printed circuit board mounted within the housing. The target switch is actuated each time that it is struck by a pinball. In response thereto, the LEDs are lit indicating the number of times that the impact target has been struck.

12 Claims, 2 Drawing Sheets

LIGHTED STAND-UP TARGET

BACKGROUND OF THE INVENTION

The present invention generally relates to pinball games and, more particularly, to a lighted stand-up target for use in such games.

Typically, pinball games include an inclined playfield supporting at least one rolling ball and a plurality of play features such as bumpers, targets, ramps and the like. The game player controls flippers mounted on the playfield to propel the ball at selected play features in an attempt to score points and to control game play.

In order to achieve a predetermined game objective, a player must repeat a given task a number of times requiring the player to use skill in operating the game. Typically, pinball games include a plurality of stand-up targets and a plurality of lights mounted to the playfield, a light being lit each time a stand-up target is hit. In such an arrangement, each of the lights is individually mounted in a hole drilled in the playfield and is separately wired to the game microprocessor via a lamp matrix such that when a particular target is hit, one of the lights on the playfield is lit. Mounting lights on the playfield in such a manner is expensive and unnecessarily increases labor and manufacturing costs.

What is desired is an inexpensively manufactured stand-up target incorporating a light display permitting a player to keep track of the number of times that a stand-up target has been hit.

SUMMARY OF THE INVENTION

The stand-up target of the invention comprises a housing mounted to the playfield and a target switch pivotably mounted to the housing which is actuated each time it is struck by a pinball. One or more light emitting diodes (LEDs) are positioned on a printed circuit board mounted within the housing, the LEDs being visible to a game player through a transparent portion of the target switch. An optical interrupter mounted on the target switch interrupts an optical switch on the circuit board to signal the game microprocessor. In response to these signals, the LEDs can be sequentially lit to keep track of the number of times that a player has struck the target.

DESCRIPTION OF A PREFERRED EMBODIMENT

Figure 1:
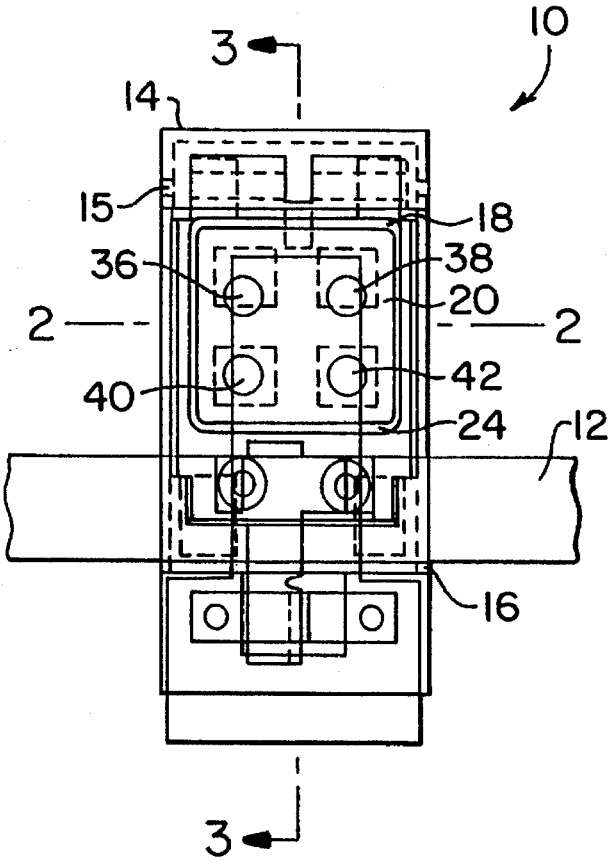
FIG. 1 is a front view of the lighted stand-up target of the invention.
Figure 2:
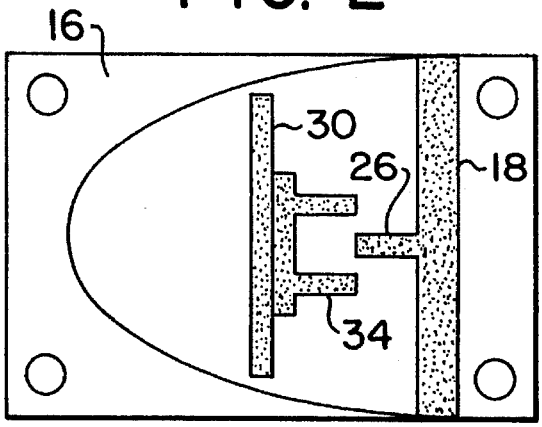
FIG. 2 is a cross-sectional view of the lighted stand-up target taken along lines 2—2 in FIG. 1.
Figure 3:
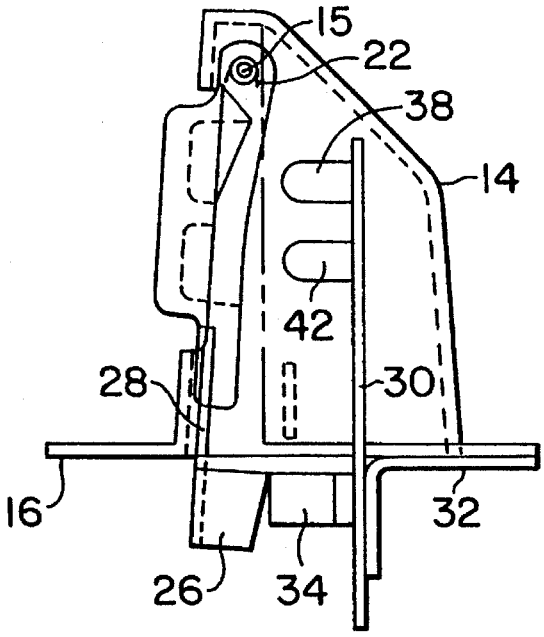
FIG. 3 is a side cross-sectional view along lines 3—3 in FIG. 1.

Referring to FIGS. 1 and 3, a lighted stand-up target 10 and playfield 12 are illustrated. Target 10 includes a housing 14 having an integral mounting plate 16 secured to the underside of playfield 12, the housing extending upwardly from plate 16 through an aperture in playfield 12. An impact target 18 is pivotably mounted to housing 14 and includes a transparent portion 20. Portion 20 is visible to a game player through a housing aperture 24. Target 18 pivots within housing 14 about axis 15 and is biased to the position shown in FIG. 3 by a spring 22. An optical interrupter 26 is attached to lower portion 28 of target 18.

A printed circuit board 30 is mounted within housing 14 to a bracket 32. An array of LEDs 36–42 (only LEDs 38 and 42 are shown in FIG. 3) is mounted on circuit board 30 behind target 18 such that each LED in the array is visible to a game player through transparent portion 20 of target 18. Optical switch 34 is attached to circuit board 30 and is actuated by optical interrupter 26 each time that the impact target 18 is struck by a pinball. The LED array and optical switch 24 are biased by appropriate biasing circuitry which is positioned on board 30. Reference is made to U.S. Pat. No. 4,856,785, incorporated hereby for additional details of the biasing circuitry for the optical switch and LEDs.

Figure 4:
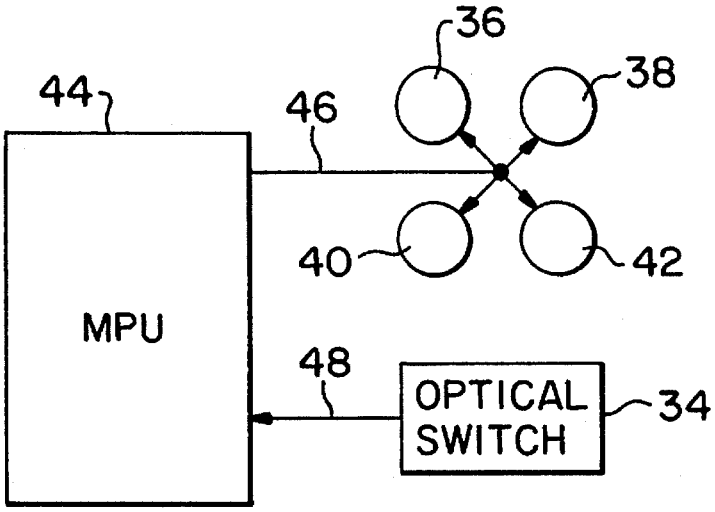
FIG. 4 is a block diagram of the optical switch, game microprocessor and LED array.

The LEDs 36–42 and the optical switch 34 are connected to the game microprocessor 44 via connections 46 and 48, respectively, as shown in FIG. 4. The game microprocessor 44 can individually control illumination of the LEDs 36–42. Any number of LEDs can be positioned on circuit board 30 in any geometric configuration desired.

An exemplary use of the lighted stand-up target of the invention follows. During the course of a game, a player attempts to score points by using the flippers to direct a pinball at the stand-up target. The stand-up target of the present invention provides a ready visual reference of the number of times that a player causes a pinball to strike target 18.

Normally, spring 22 biases target switch 18 against housing 14 in the unactuated position illustrated in FIG. 3, By skillfully operating the flippers, a player can propel a pinball toward the lighted stand-up target in an attempt to strike target switch 18 with the pinball. If target switch 18 is struck with sufficient force to overcome the bias of spring 22, then target 18 is rotated to an actuated position wherein optical interrupter 26 actuates optical switch 34. Referring to FIGS. 3 and 4, when optical switch 34 is actuated, a signal is sent to the game microprocessor 44 via connection 48. In response, the game microprocessor, according to its programming, will light one or more of LEDs 3642. If desired, LEDs 42–46 can be used to denote the number of times that a player accomplishes other predetermined tasks besides striking target 18.

If desired, LEDs of various colors can be used in one housing and an array of stand-up targets can be mounted in spaced-relation on the playfield. In this case, a player can attempt to light the LEDs having the same color in each stand-up target sequentially.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. In combination with a pinball game having an inclined playfield supporting a rolling ball thereon, a stand up target comprising:

a) a housing mounted on the playfield;

b) a target pivotally mounted to the housing for movement from a first position to a second position when contacted by the rolling ball, said target including a view window; and c) display means within the housing and visible through the target view window, for indicating to a player that the target has been hit by the pinball.

2. The combination of claim 1, wherein the display means comprises a plurality of discrete light sources

3. The combination of claim 2, wherein the display means further comprises control means for illuminating one of the light sources each time the target is contacted by the rolling ball.

4. The combination of claim 2, wherein the control means includes a switch actuated when the pinball strikes the target, and a microprocessor operatively connected to the switch for monitoring the status thereof.

5. The combination of claim 4, wherein the light sources are mounted on a circuit board disposed within the housing.

6. The combination of claim 1, wherein the switch is an optical switch and the target is provided with an interrupter for actuating the optical switch when struck by the pinball.

7. The combination of claim 8, further including a spring to bias the target to the first position.

8. A play feature for a pinball game having an inclined playfield for supporting a rolling ball thereon, the play feature comprising:

a) a stand-up target body to be mounted on the playfield and having a view window mounted for movement from a first position to a second position when contacted by the rolling ball, and b) display means, associated with the target body and visible through the window, for indicating the number of times that the target has been hit by the ball.

9. A play feature for a pinball game having an inclined playfield for supporting a rolling ball thereon, the play feature comprising:

a) a housing to be mounted on the playfield;

b) a stand-up target body pivotably mounted to the housing, the target body having a view window;

c) display means with said housing, visible through the window, for indicating to a player the number of times that the target body has been hit by the ball.

10. The play feature of claim 9, wherein the display means comprises a plurality of discrete light sources

11. The play feature of claim 10, wherein the display means further comprises control means for illuminating one of the light sources each time the target body is contacted by the rolling ball.

12. The play feature of claim 11, wherein the control means comprises a switch actuated when the target body moves from the first position to the second position, and a microprocessor connected to the switch for monitoring the status thereof.

* * * * *

UNITED STATES PATENT AND TRADEMARK OFFICE

CERTIFICATE OF CORRECTION

PATENT NO. : 5,529,294

DATED : June 25, 1996

INVENTOR(S) : Dennis P. Nordman, et. al.

It is certified that error appears in the above-indentified patent and that said Letters Patent is hereby corrected as shown below:

Column 3,

Claim 4, should depend from claim 3--.
Claim 5, should depend from claim 2--.
Claim 6, should depend from claim 4--.
Claim 7, should depend from claim 1--.

Signed and Sealed this

Twenty-fourth Day of September, 1996

*Attest:*

Bruce Lehman

BRUCE LEHMAN

*Attesting Officer*

*Commissioner of Patents and Trademarks*